US006167591B1

(12) United States Patent
Daoud

(10) Patent No.: US 6,167,591 B1
(45) Date of Patent: Jan. 2, 2001

(54) HINGE PROVIDING AN ELECTRICAL CONNECTION

(75) Inventor: Bassel Hage Daoud, Parsippany, NJ (US)

(73) Assignee: Lucent Technologies, Inc., Murray Hill, NJ (US)

( * ) Notice: Under 35 U.S.C. 154(b), the term of this patent shall be extended for 0 days.

(21) Appl. No.: 09/120,596

(22) Filed: Jul. 22, 1998

(51) Int. Cl.[7] ..... E06B 3/48

(52) U.S. Cl. ..... 16/387; 16/388; 16/307; 16/277

(58) Field of Search ..... 16/221, 223, 277, 16/286, 289, 306, 307, 337, 388; 439/31, 95, 165

(56) References Cited

U.S. PATENT DOCUMENTS

| | | | | |
|---|---|---|---|---|
| 426,597 | * | 4/1890 | Libbey | 16/277 |
| 515,334 | * | 2/1894 | Held | 16/277 |
| 531,515 | * | 12/1894 | Davis | 439/31 |
| 615,209 | * | 11/1898 | Baxter | 439/31 |
| 919,154 | * | 4/1909 | Gen | 16/388 |
| 1,344,538 | * | 6/1920 | Kaufman | 16/307 |
| 2,853,924 | * | 9/1958 | Herzfeld et al. | 16/307 |
| 3,106,010 | * | 10/1963 | Morrell | 16/307 |
| 3,128,898 | * | 4/1964 | Burman, Jr. | 16/277 |
| 3,362,041 | * | 1/1968 | Fynewever | 16/335 |
| 3,811,489 | * | 5/1974 | Thun et al. | 16/307 |
| 4,195,372 | * | 4/1980 | Farina | 16/335 |
| 5,267,866 | * | 12/1993 | Swift et al. | 439/31 |

FOREIGN PATENT DOCUMENTS

| | | | | |
|---|---|---|---|---|
| 367588 | * | 1/1923 | (DE) | 16/223 |
| 4937 | * | 11 1882 | (GB) | 16/277 |

* cited by examiner

*Primary Examiner*—Anthony Knight
*Assistant Examiner*—Mark Williams
(74) *Attorney, Agent, or Firm*—Baker & McKenzie

(57) ABSTRACT

A hinge which includes a first leaf member, a second leaf member, and a pin rotatably connecting the first leaf member to the second leaf member. The hinge also includes a first contact member connected to the first leaf member and a second contact member connected to the second leaf member. A contact portion of the first contact member and the second contact member establish an electrical connection with each other.

17 Claims, 5 Drawing Sheets

HINGE PROVIDING AN ELECTRICAL CONNECTION

FIELD OF THE INVENTION

The present invention relates to the field of hinges, in particular to a hinge providing an electrically-conductive path therethrough.

BACKGROUND INFORMATION

In certain applications, for example, electrical devices for outdoor use, electrical and electronic components (hereinafter "components") are mounted on a cover and base of box, such as an electrically-conductive box. In such systems, the components are connected to ground through the use of a grounding cable forming an electrically-conductive path between the box and the components. The grounding cable is usually heavy and does not bend easily. Thus, it is generally connected to the stationary part of the box, that is, the base, not the movable cover. A stranded cable is used to form an electrically-conductive path between the cover and the base of the box to allow the components mounted on the cover to also be grounded to the base of the box. Although utilizing a stranded wire to form an electrically-conductive path between the cover and the base of the box to ground components therein has generally been accepted, such a technique interferes with the user's access to the components mounted on the box. Users may disconnect the stranded cable to access the components, however, disconnecting the stranded cable is time consuming and may result in it not being reconnected. In this case, the components will not be grounded and may be rendered nonfunctional or susceptible to damage.

SUMMARY OF THE INVENTION

An object of the present invention is providing a contact member which is resiliently displaceable and establishes an electrical connection with another member.

Another object of the present invention is to provide a hinge which can establish a proper electrical connection.

It is still another object of the present invention to provide a hinge having contact members which maintain the hinge in an open state.

It is still yet another object of the present invention to provide a hinge which can provide a proper electrical connection between a cover and base while allowing a user easy access to the components therein.

It is still yet another object of the present invention to provide a hinge which can provide a proper electrical connection between a cover and base of a box and prevent the components from nonfunctioning and damage.

An aspect of the present invention provides a contact member which includes an attachment portion, a contact portion, and a middle portion connected to the attachment portion and contact portion. The contact portion is resiliently displaceable with respect to the attachment portion. Further, the attachment portion is adapted to attach to a pin and the contact portion is adapted to make electrical contact with another member.

Another aspect of the present invention provides a hinge which includes a first leaf member, a second leaf member, and a pin rotatably connecting the first leaf member to the second leaf member. The hinge also includes a first contact member which is connected to a first leaf member and a second contact member which is connected to a second leaf member. The first contact member and the second contact member exert force on the first leaf member and the second leaf member, respectively. Further, contact portions of the first contact member and the second contact member respectively establish an electrical connection with each other. The contact portions respectively maintain the electrical connection with each other throughout a range of angular displacement between the first leaf member and the second leaf member.

In yet another aspect of the present invention, a hinge is provided for movably connecting a cover and a base of a box. The hinge includes a first leaf member connected to the base of the box and a second leaf member connected to the cover of the box. A pin rotatably connects the first leaf member to the second leaf member. The hinge also includes a first contact member which is connected to the first leaf member and a second contact member which is connected to the second leaf member. The contact portions of the first contact member and second contact member respectively form an electrical connection with each other. Further, the contact portions of the first contact member and the second contact member maintain the electrical connection with each other throughout a range of angular displacement between the first leaf member and the second leaf member.

DETAILED DESCRIPTION

Figure 1:
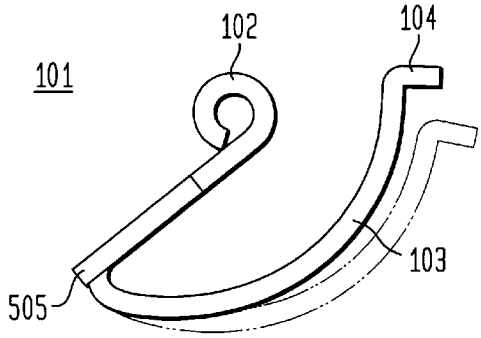
FIG. 1 shows an exemplary embodiment of a contact member of the present/invention.

As shown in FIG. 1, an exemplary embodiment of the present invention includes a contact member 101 which includes an attachment portion 102, a contact portion 104, and a middle portion 103. The middle portion 103 is, for example, arcuate and joins the attachment portion 102 and the contact portion 104. In an exemplary embodiment of the present invention, the attachment portion 102, contact portion 104, and middle portion 103 can be formed in a unitary piece to decrease the time for manufacturing the contact member and to reduce its manufacturing cost. The contact portion 104 is resiliently displaceable with respect to the attachment portion 102. For example, the contact member 101 may be a resilient, electrically-conductive material such as spring steel.

Figure 2:
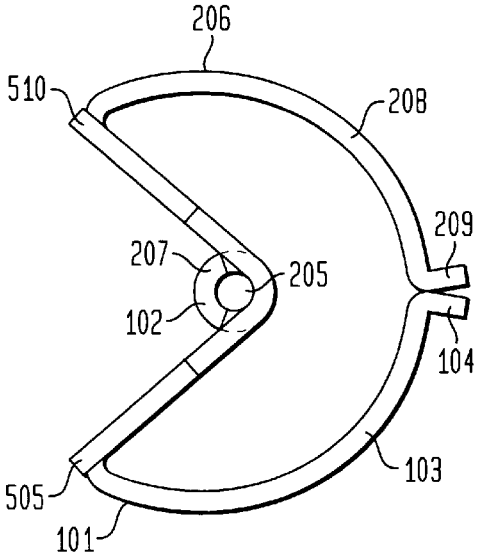
FIG. 2 shows an exemplary embodiment of the contact member of FIG. 1 in cooperation with another member.
Figure 3:
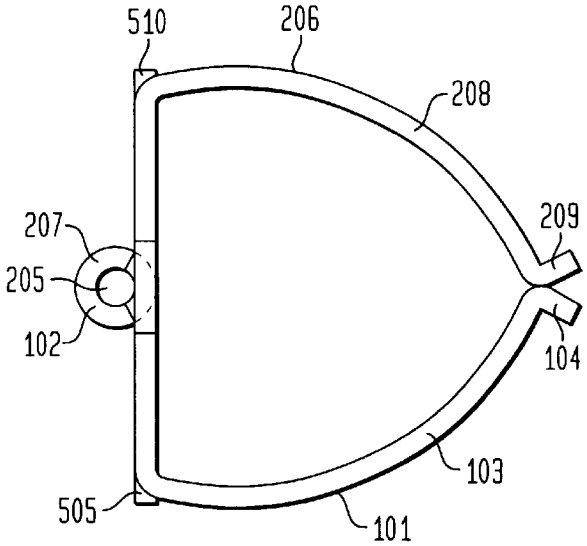
FIG. 3 shows an exemplary embodiment of the contact member of FIG. 1 in cooperation with another member.

As shown in FIG. 2, a first attachment portion 102 of a first contact member 101 is adapted to attach to, for example, a pin 205. In an exemplary embodiment of the present invention, the first attachment portion 102 includes a loop. In another exemplary embodiment of the present invention, the first attachment portion 102 may include a first leaf member 505. Further, a first contact portion 104 of the first contact member 101 of the present invention is adapted to make electrical contact with another member. In an exemplary embodiment of the present invention, the first contact portion 104, as shown in FIG. 2, may include a smooth, curved area which can be placed in contact with a second contact portion 209 of a second contact member 206. The second contact member 206 also includes a second attachment portion 207. In an exemplary embodiment of the present invention, as shown in FIG. 3, the first attachment portion 102 and the second attachment portion 207 rotatably engage the pin, and the first contact portion 104 contacts the second contact portion 209. Further, the second contact member 206, for example, may be constructed the same as the first contact member 101. In an exemplary embodiment of the present invention, at least one of the first attachment portion 102 and second attachment portion 207 is connected to or includes a leaf member 505, 510.

Figure 4A:
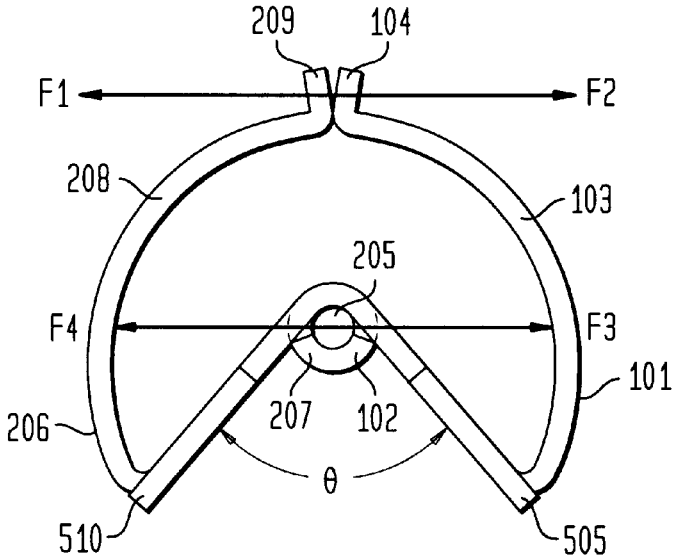
FIGS. 4A and 4B show an exemplary embodiment of the forces generated by the present invention.
Figure 4B:
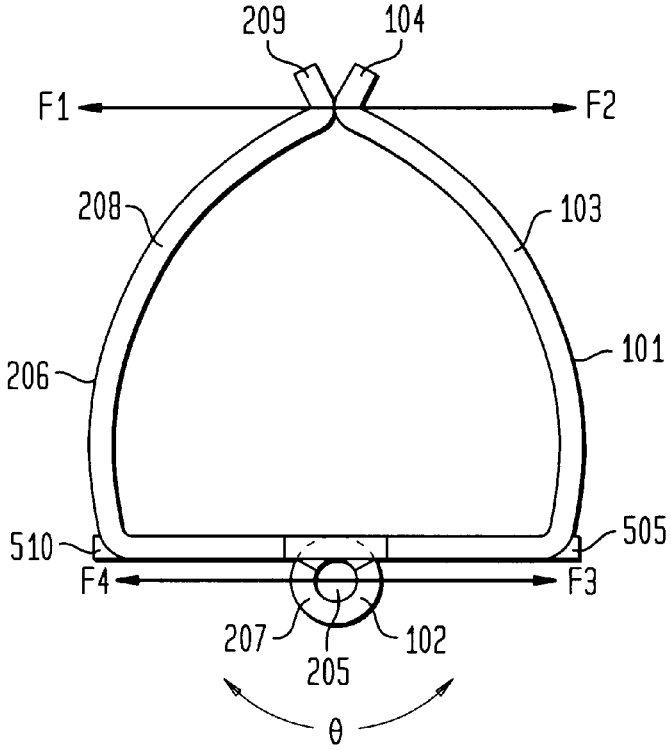

Cooperation between the pin 205 and the contact members 101 and 206, and cooperation of the contact members 101, 206 with each other enable the hinge to establish a proper electrical connection, that is, a connection not susceptible to movement and the generation of noise. As shown in FIGS. 4A and 4B, the engagement of the first and second attachment portions 102, 207 with the pin and the contact between the first and second contact portions 104, 209 of the respective arcuate contact members 101, 206, generate forces. For example, the first and second contact portions 104, 209 exert forces, F1, F2, respectively, on each other and the first and second attachment portions 101, 207 exert forces F3, F4, respectively, on the pin 205.

The forces F1, F2 exerted by the first contact portion 104 and second contact portion 209 prevent undesirable movement with respect to each other and thus, allow a stable and secure contact not susceptible to noise. Without the forcible contact of the present invention, the first contact portion 104 and second contact portion 209 may move sufficiently with respect to each other and induce unwanted noise into the electrical connection. In an exemplary embodiment of the present invention, the first contact member 101 and the second contact member 206 maintain an electrical connection with each other throughout a range of angular displacement between the first leaf member 505 and the second leaf member 510. The length and amount of arc of the contact members 101, 206 can be selected, for example, so that the contact members maintain the electrical connection with each other throughout a range of angular displacement of approximately 0 degrees to 360 degrees. For example, as shown in FIG. 4B, a proper electrical connection is provided between the first contact portion 104 and the second contact portion 209 with the angle, θ, between the first leaf member 505 and the second leaf member 510 is approximately 180 degrees. Further, as shown in FIG. 4A, when the angle, θ, between the first leaf member 505 and second leaf member 510 is less than 180 degrees the first and second contact portions 104, 209 are positioned closer to the pin 205 and the attachment portions 102, 207 and a proper electrical connection is still maintained therebetween. Further, in an exemplary embodiment of the present invention, the forces F3, F4, respectively exerted by the first and second attachment portions 102, 207 prevent movement and unwanted noise from the pin 205 and the first leaf member 505 and second leaf member 510.

Figure 5A:
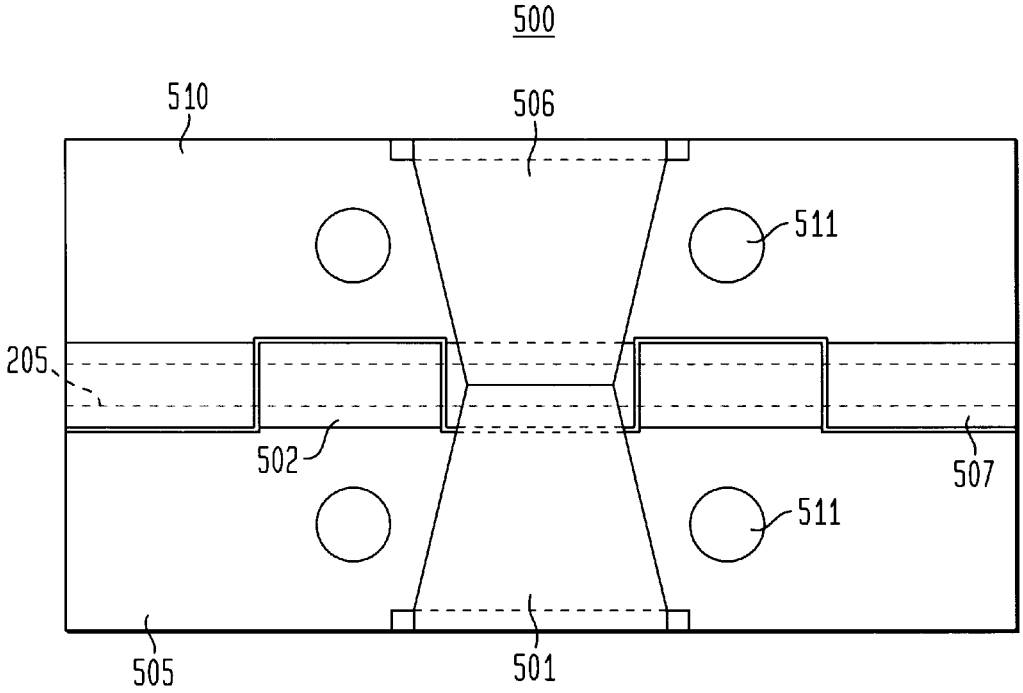
FIG. 5A shows an exemplary embodiment of a hinge of the present invention.
Figure 5B:
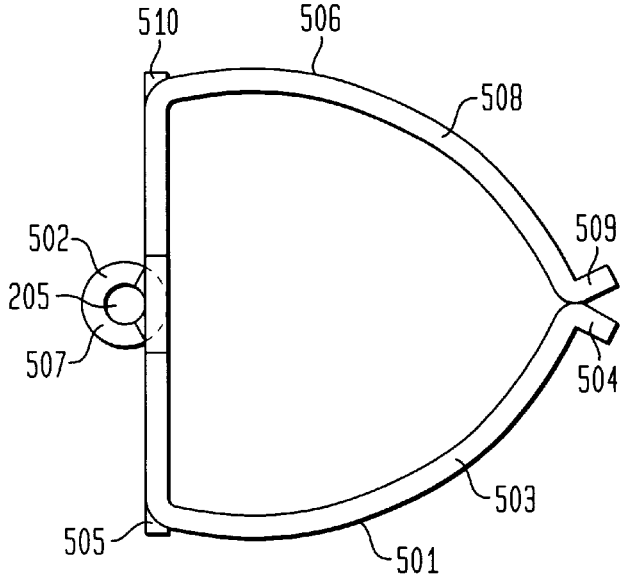
FIG. 5B shows a side view of the hinge of FIG. 5A.

FIGS. 5A and 5B show an exemplary embodiment of a hinge 500 of the present invention which includes a first leaf member 505, a second leaf member 510, and a pin 205 rotatably connecting the first leaf member 505 to the second leaf member 510. The first and second leaf members 505, 510 may also include apertures 511, for example, to allow the leaf members 505, 510 to be fastened to an object such as a box. In an exemplary embodiment of the present invention, the first leaf member 505 includes a first attachment portion 502 and the second leaf member 510 includes a second attachment portion 507, for example, as shown in FIGS. 5A and 5B. The attachment portions 502, 507 of the leaf members 505, 510 are rotatably attached to the pin 205. The hinge 500 also includes a first contact member 501 and a second contact member 506. The first contact member 501 is connected to the first leaf member 505 and the second contact member 506 is connected to the second leaf member 510. In an exemplary embodiment of the present invention, the first leaf member 505 and the first contact member 501 are formed as a first unitary piece and the second leaf member 510 and the second contact member 506 are formed as a second unitary piece. In another embodiment of the present invention, the contact members 501, 506 are, for example, welded or soldered, to their respective leaf members 505, 510.

Figure 6:
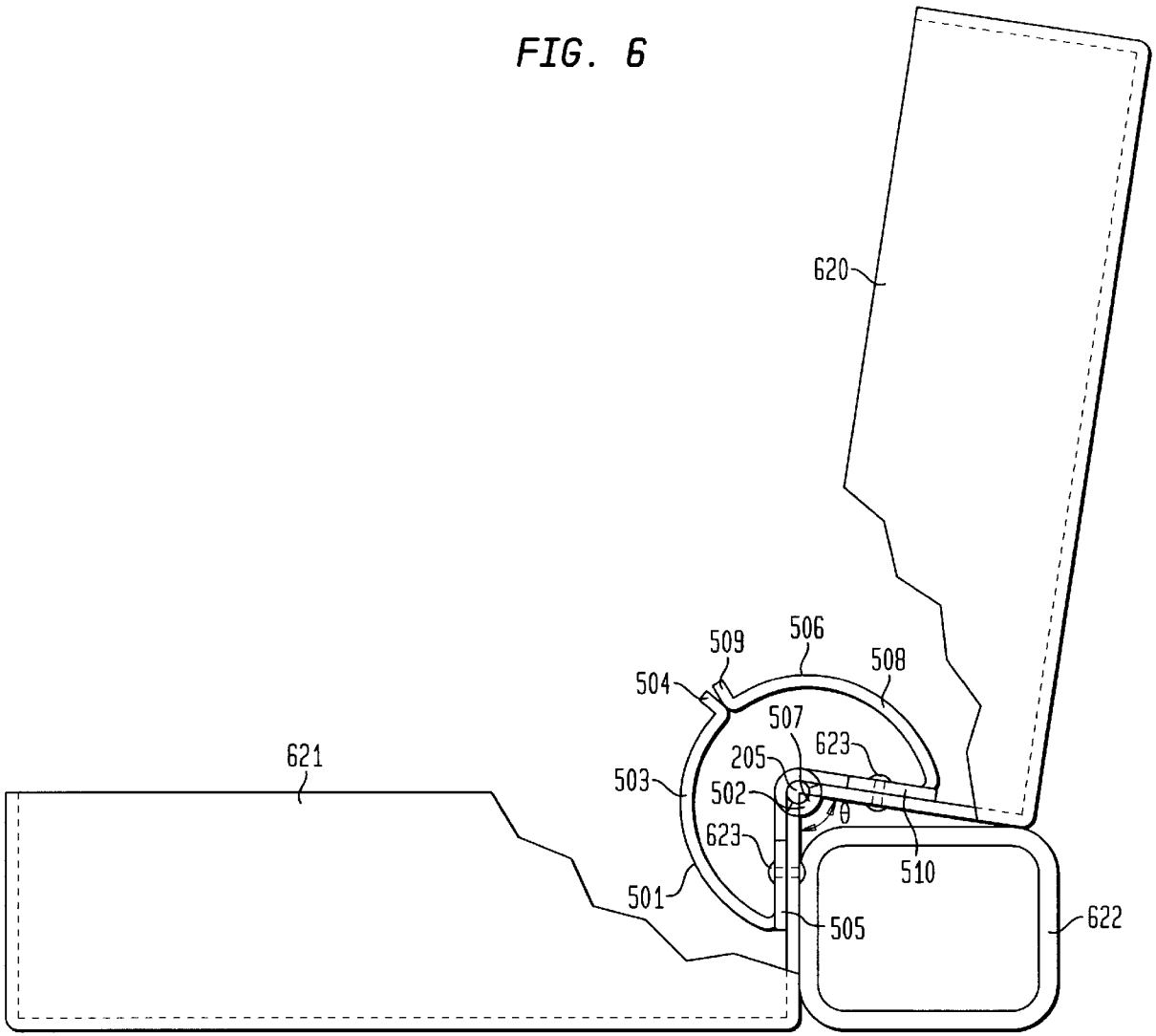
FIG. 6 shows an exemplary embodiment of a hinge of the present invention connected to a box in an open state.

As shown in FIGS. 4A and 4B, and previously discussed with reference thereto, the forces generated by the hinge prevent noise and allow a proper electrical connection between the first contact portion 104 and the second contact portion 209. In addition, forces generated by the hinge, are also exerted on the first leaf member 505 and the second leaf member 510. Such forces can maintain the angular displacement, 0, between the respective members 505, 510 at or within a predetermined range to keep the hinge in an open state, for example, at an angle, θ, of approximately 90 degrees as shown in FIG. 6. The application of a sufficient amount of force, however, can place the hinge in a closed state, for example, at an angle, θ, of approximately 180 degrees as shown in FIG. 7.

Figure 7:
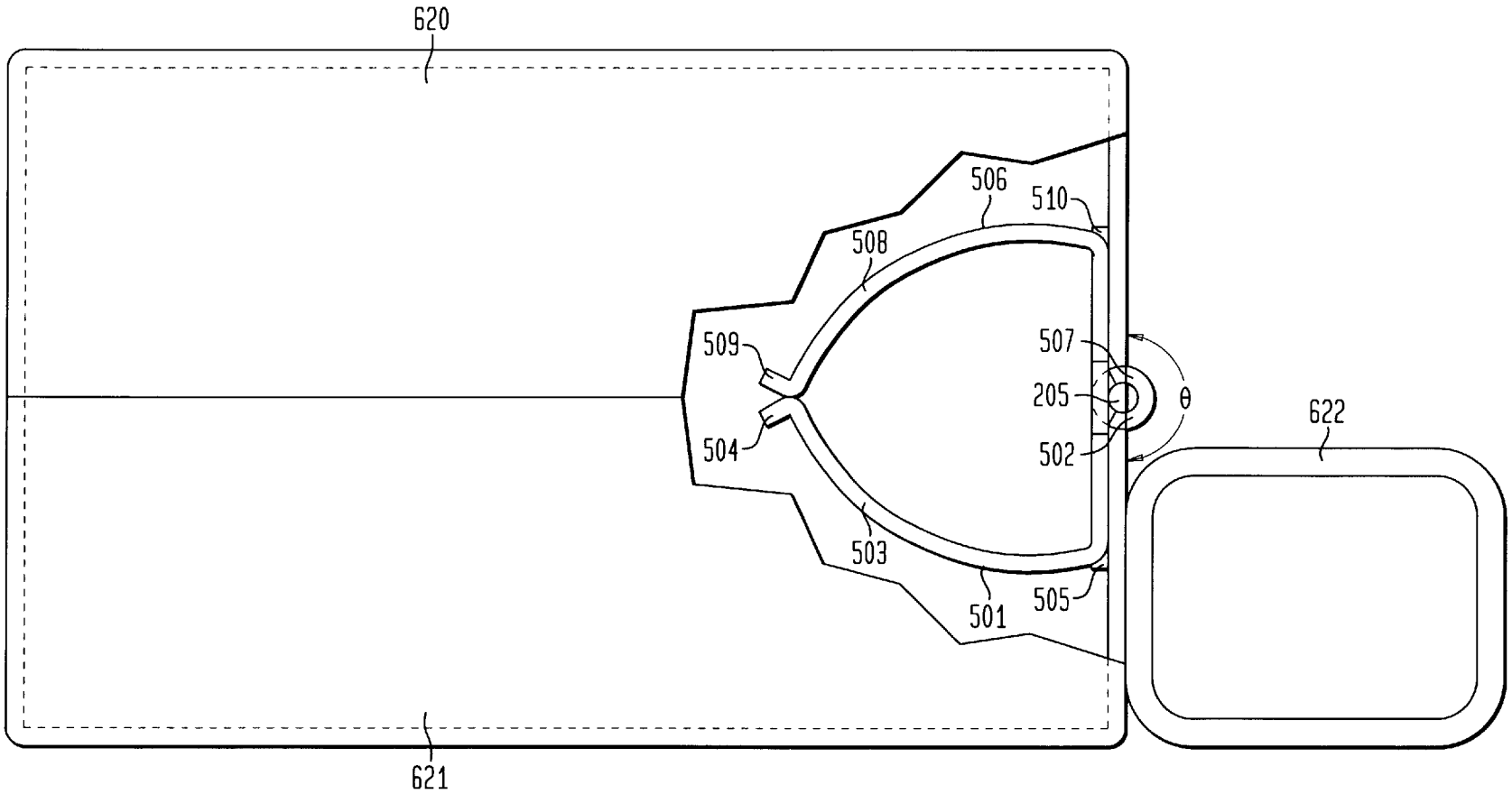
FIG. 7 shows an exemplary embodiment of a hinge of the present invention connected to a box in a closed state.

In an exemplary embodiment of the present invention as shown in FIGS. 6 and 7, a hinge 500 movably connects a cover 620 and a base 621 of a box with components mounted therein. In an exemplary embodiment of the present invention, the box is formed from an electrically-conductive material, for example, such as metal. The hinge 500 includes a first leaf member 505 connected to the base 621 of the box, a second leaf member 510 connected to the cover 620 of the box, and a pin 205 rotatably connecting the first leaf member 505 to the second leaf member 510. The leaf members 505, 510 may be respectively connected to the box by being welded, soldered or fastened, such as with a rivet 623. In an exemplary embodiment of the present invention, the first and second leaf members 505, 510 are respectively electrically connected to the base 621 and the cover 620 of the box. As previously described in an exemplary embodiment of the present invention with respect to FIGS. 4A, 4B, 5A and 5B, the hinge 500 also includes a first contact member 501 which connects to the first leaf member 505 and a second contact member 506 which connects to the second leaf member 510. The second contact member 506 forms an electrical connection with the first contact member 501. Further, the first attachment portion 502 of the first leaf member 505 and a second attachment portion 507 of the second leaf member 510 are respectively rotatably connected to the pin 205, and a first contact portion 504 of the first contact member 501 and a second contact portion 509 of the second contact member 506 forcible contact each other. Accordingly, in an exemplary embodiment of the present invention, the hinge 500 provides an electrically-conductive path between the 620 cover and base 621 of the box.

The first contact portion 504 and the second contact portion 509 maintain electrical connection with each other throughout a range of angular displacement between the first leaf member 505 and the second leaf member 510. As shown in FIG. 6, the electrical connection is maintained with the box in an open state, that is, when the angle, θ, between the first leaf member 505 and the second leaf member 510 is less than 180 degrees. Further, as shown in FIG. 7, the electrical connection is maintained with the box in a closed state, that is, the angle, θ, is approximately 180 degrees.

As shown in FIG. 6, in an exemplary embodiment of the present invention, the box may be placed in an open state with the cover resting, for example, on a wire trough 622. In the open state, the first contact member 501 and the second contact member 506 exert force on the first leaf member 505 and the second leaf member 510. Such forces will prevent the box from being moved from an open state, as shown in FIG. 6, to a closed state, as shown in FIG. 7, by certain unintentional movements of the box.

The embodiments described above are illustrative examples of the present invention and it should not be construed that the present invention is limited to these particular embodiments. Various changes and modifications may be effected by one skilled in the art without departing from the spirit or scope of the invention as defined in the appended claims.

What is claimed is:

1. A contact member comprising:

an attachment portion, the attachment portion rotatably connected to a pin;

a contact portion, the contact portion resiliently displaceable with respect to the attachment portion and operable to make direct and continuous contact with another contact portion so that an electrical connection is formed between the contact portion and the another contact portion; and a middle portion connecting the attachment portion and the contact portion, wherein the attachment portion, the contact portion and the middle portion are comprised of a resilient conductive material, whereby an electrical connection is formed therethrough.

2. The contact member according to claim 1, wherein the middle portion is arcuate.

3. The contact member according to claim 1 wherein the attachment portion is adapted to attach to a pin.

4. The contact member according to claim 1, wherein the attachment portion includes a loop.

5. The contact member according to claim 1, wherein the resilient material is spring steel.

6. The contact member according to claim 1, wherein the middle portion, the attachment portion, and the contact portion are comprised of an electrically-conductive material.

7. The contact member according to claim 1, wherein the attachment portion is also connected to a leaf member.

8. The contact member according to claim 1, wherein the attachment portion is a leaf member.

9. A hinge comprising:

a first leaf member;

a second leaf member;

a pin rotatably connecting the first leaf member to the second leaf member;

a first contact member connected to the first leaf members the first contact member having a first contact portion;

a second contact member connected to the second leaf members the second contact member having a second contact portion operable to make direct and continuous contact with the first contact portion of the first contact member so that an electrical connection is formed between the first contact portion and the second contact portion;

a first attachment portion of the first contact member resiliently displaceable with respect to the first contact portion, the first attachment portion rotatably connected to the pin; and a second attachment portion of the second contact member resiliently displaceable with respect to the second contact portion, the second attachment portion rotatably connected to the pin, wherein the first contact member and the second contact member are comprised of a resilient conductive material, whereby an electrical connection is formed therethrough.

10. The hinge according to claim 9 wherein the first contact member and the first leaf member are formed as a first unitary piece and the second contact member and the second leaf member are formed as a second unitary piece.

11. The hinge according to claim 9, wherein the first contact member and the second contact member exert force on the first leaf member and the second leaf member, respectively.

12. The hinge according to claim 9, wherein the first contact portion and the second contact portion maintain an electrical connection with each other throughout a range of angular displacement between the first leaf member and the second leaf member.

13. The hinge according to claim 12 wherein the first leaf member electrically connects to a base of a box, and the second leaf member electrically connects to a cover of the box.

14. A hinge for movably connecting a cover and a base of a box, the hinge comprising:

a first leaf member connected to the base of the box;

a second leaf member connected to the cover of the box;

a pin rotatably connecting the first leaf member to the second leaf member;

a first contact member which connects to the first leaf member, the first contact member having a first contact portion;

a second contact member which connects to the second leaf member, the second contact member having a second contact portion operable to make direct and continuous contact with the first contact portion so that an electrical connection is formed between the first contact portion and the second contact portion;

a first attachment portion of the first contact member resiliently displaceable with respect to the first contact portion, the first attachment portion rotatably connected to the pin; and a second attachment portion of the second contact member resiliently displaceable with respect to the second contact portion, the second attachment portion rotatably connected to the pin, wherein the first contact member and the second contact member are comprised of a resilient conductive material, whereby an electrical connection is formed therethrough.

15. The hinge according to claim 14, wherein the first contact portion and the second contact portion maintain the electrical connection with each other throughout a range of angular displacement between the first leaf member and the second leaf member.

16. The hinge according to claim 15, wherein the first contact member and the second contact member exert force on the first leaf member and the second leaf member maintaining the box in an open state.

17. The hinge according to claim 16, wherein the box is comprised of an electrically-conductive material.

* * * * *